US008963028B2

(12) United States Patent
Chou

(10) Patent No.: US 8,963,028 B2
(45) Date of Patent: Feb. 24, 2015

(54) MULTI-POINT TILT SWITCH

(71) Applicant: Tien-Ming Chou, Taichung (TW)

(72) Inventor: Tien-Ming Chou, Taichung (TW)

( * ) Notice: Subject to any disclaimer, the term of this patent is extended or adjusted under 35 U.S.C. 154(b) by 122 days.

(21) Appl. No.: 13/768,101

(22) Filed: Feb. 15, 2013

(65) Prior Publication Data

US 2014/0231231 A1 Aug. 21, 2014

(51) Int. Cl.
*H01H 35/02* (2006.01)

(52) U.S. Cl.
CPC ..... *H01H 35/02* (2013.01)
USPC ..... 200/61.52

(58) Field of Classification Search
USPC ..... 200/61.52, 277, 1 R, 61.11, 61.45 M, 200/61.45 R, 84 R, 220, 193, 229, 52 R, 215
See application file for complete search history.

(56) References Cited

U.S. PATENT DOCUMENTS

| | | | | |
|---|---|---|---|---|
| 7,884,294 | B2 * | 2/2011 | Chou | 200/277 |
| 7,897,887 | B2 * | 3/2011 | Blank | 200/61.45 R |
| 2010/0044197 | A1 * | 2/2010 | Chou | 200/302.1 |

* cited by examiner

*Primary Examiner* — Edwin A. Leon
(74) *Attorney, Agent, or Firm* — McNees Wallace & Nurick LLC

(57) ABSTRACT

A multi-point tilt switch includes an insulator housing surrounding a chamber, a first conductive component mounted to the housing and having a contact portion bordering the chamber, a plurality of second conductive components each having a contact portion in the chamber, and a conductor accommodated in the chamber. Each of the first and second conductive components has a connection portion exposed from the housing. The conductor is movable in the chamber to contact or not to contact the contact portions of at least two of the first and second conductive components, so as to make or break electrical connection therebetween.

10 Claims, 12 Drawing Sheets

MULTI-POINT TILT SWITCH

BACKGROUND OF THE INVENTION

1. Field of the Invention

The invention relates to a tilt switch, and more particularly to a multi-point tilt switch.

2. Description of the Related Art

Referring to FIG. 1, a conventional switch 1 disclosed in Taiwanese patent no. M365538 is shown to include a shell 11 defining a chamber 10, four conductive terminals 12, and a conductor 13 accommodated in the chamber 10. The conductive terminals 12 respectively have a contact portion 121 passing through the shell 11 and exposed in the chamber 10, and a connection portion 122 exposed from outside the shell 11. The conductor 13 is rollable between a conducting position at which the conductor 13 contacts any two of the contact portions 121, and a non-conducting position at which the conductor 13 does not contact any two of the contact portions 121, so as to make or break electrical connection in an X-axis direction or a Y-axis direction.

However, the switch 1 has the switch function at only angles in X-axis or Y-axis directions. The aforesaid example may provide switch function in only four directions, and may not satisfy current requirements.

SUMMARY OF THE INVENTION

Therefore, an object of the present invention is to provide a multi-point tilt switch that may provide switch function in a larger number of directions.

According to the present invention, a multi-point tilt switch comprises:

an insulator housing having an annular housing inner surface surrounding a chamber;

at least one first conductive component mounted to the housing, and having a contact portion bordering the chamber, and a connection portion exposed from the housing;

a plurality of second conductive components spaced apart from the first conductive component, each of the second conductive components having a contact portion disposed in the chamber, and a connection portion exposed from the housing; and a conductor accommodated in the chamber, and movable in the chamber between a conducting position at which the conductor contacts the contact portions of at least two of the first and second conductive components, and a non-conducting position at which the conductor does not contact the contact portions of any two of the first and second conductive components.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
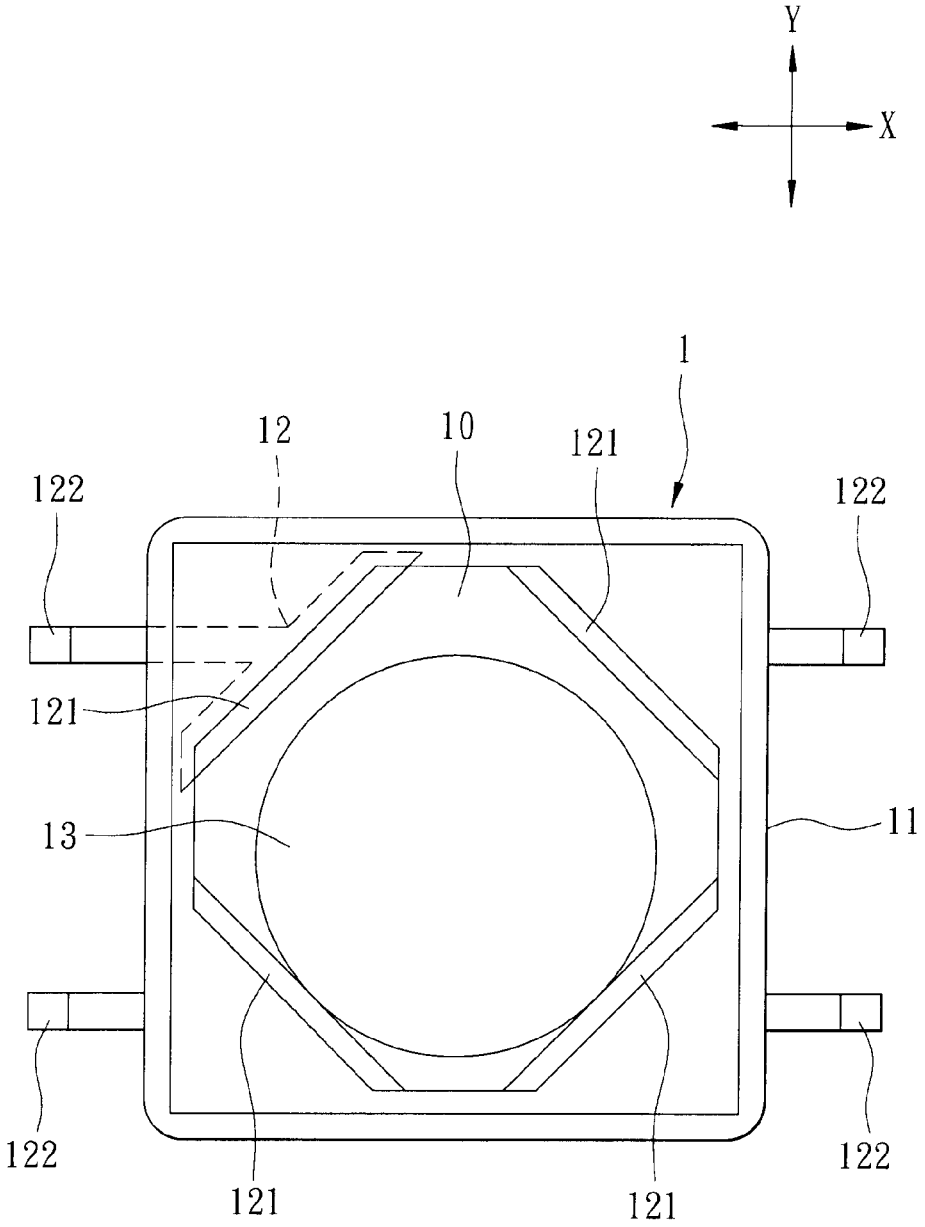
FIG. 1 PRIOR ART
FIG. 1 is a schematic view illustrating a conventional switch.
Figure 2:
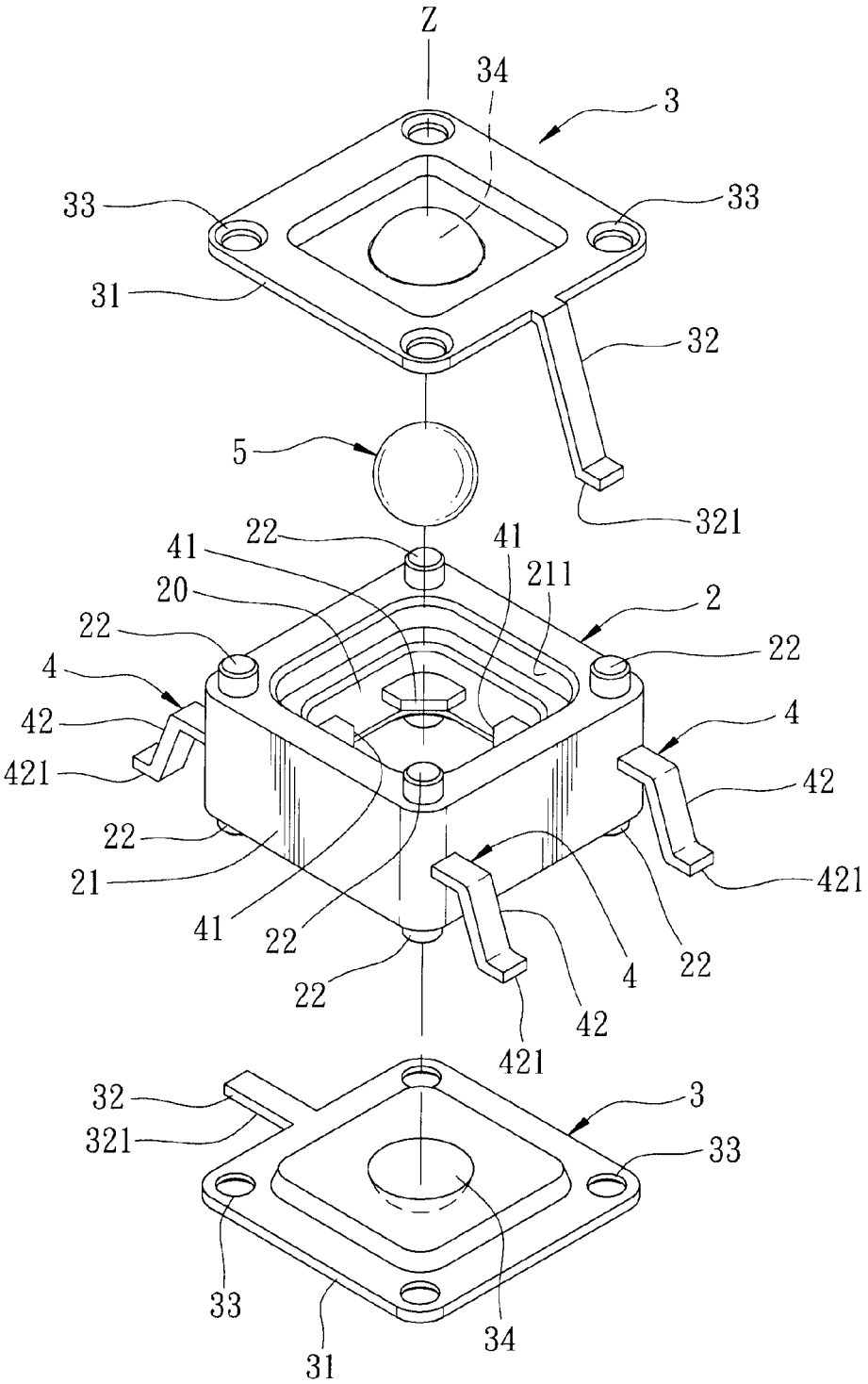
FIG. 2 is an exploded perspective view illustrating a first preferred embodiment of a multi-point tilt switch according to the present invention.
Figure 3:
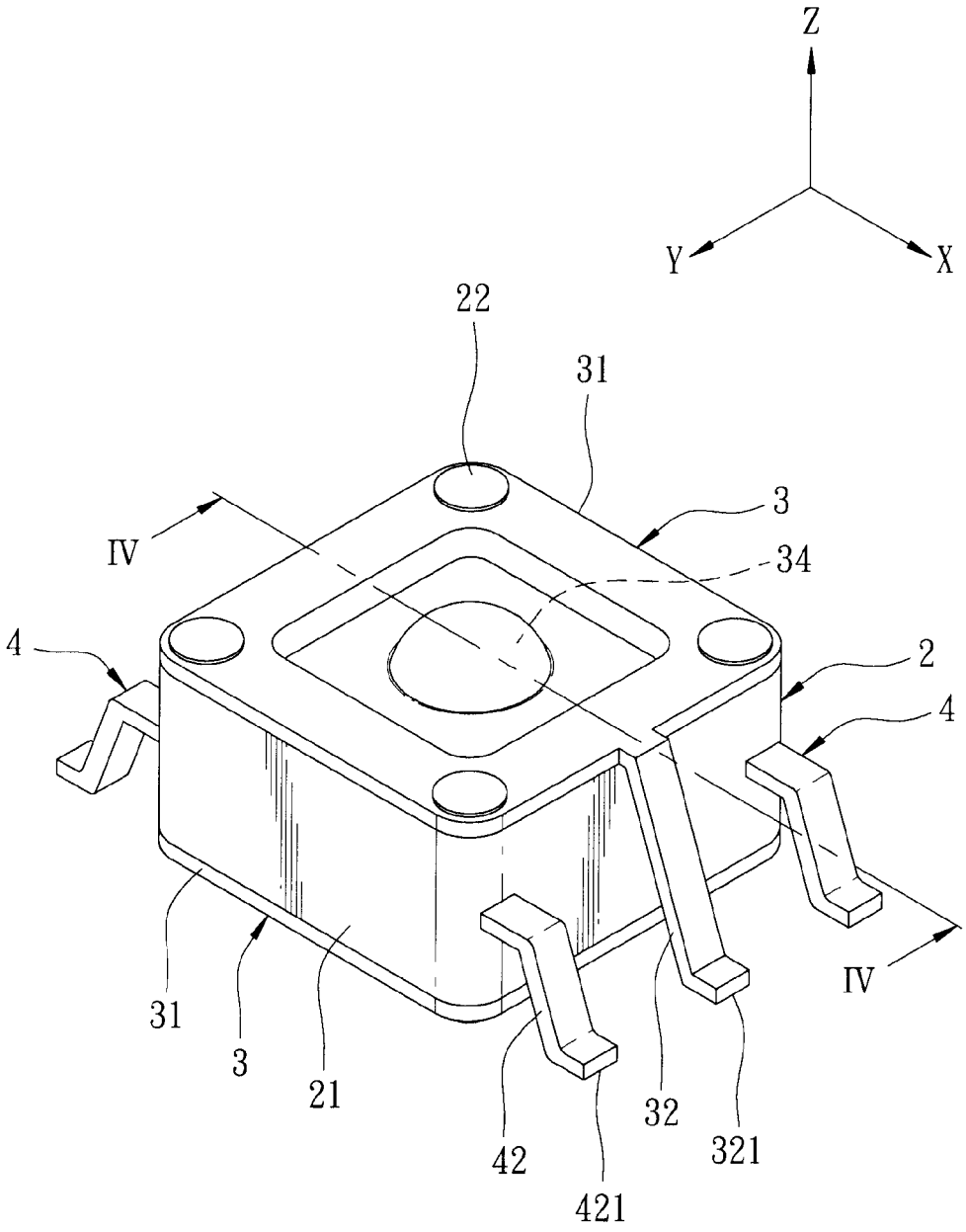
FIG. 3 is an assembled perspective view showing the first preferred embodiment.
Figure 4:
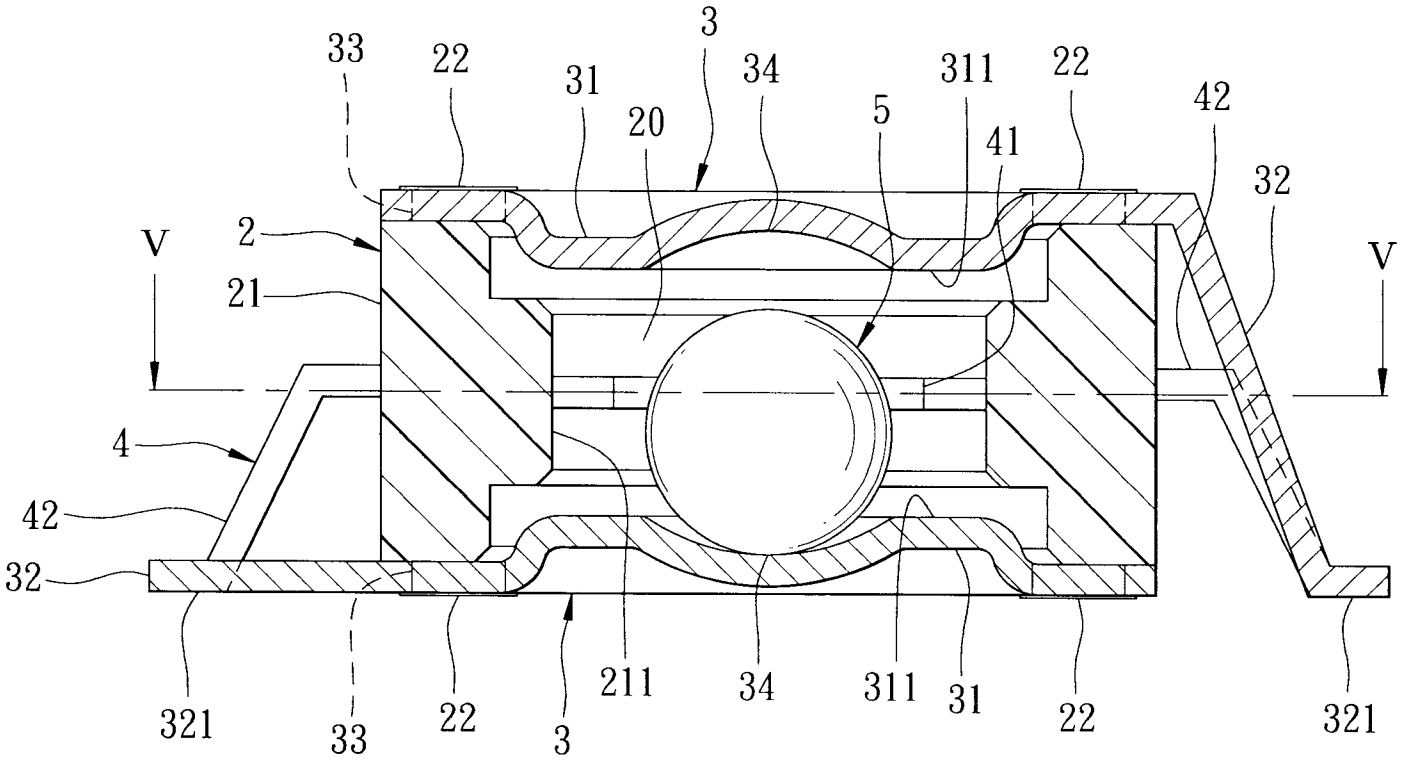
FIG. 4 is a sectional view of the first preferred embodiment taken along line IV-IV in FIG. 3.

Referring to FIGS. 2 to 4, the first preferred embodiment of the multi-point tilt switch according to this invention is shown to include an insulator housing 2, two first conductive components 3, a plurality of second conductive components 4, and a conductor 5.

The housing 2 has a surrounding wall 21 that has an annular housing inner surface 211 surrounding a chamber 20 and that surrounds an axis Z. The chamber 20 has two axially opposed open ends, and the surrounding wall 21 has two axially opposite ends defining the open ends of the chamber 20. The opposite ends of the surrounding wall 21 are formed with interlocking elements, which are protrusions 22 in this embodiment for interlocking with the first conductive components 3. Each of the protrusions 22 may be one of a pillar, a rib, and a protruding block. In this embodiment, each of the protrusions 22 is a pillar.

The first conductive components 3 are mounted to the housing 2, and respectively have a contact portion 31 bordering the chamber 20, and a connection portion 32 exposed from the housing 2. In this embodiment, the contact portion 31 of each first conductive component 3 is formed with interlocking elements, which are indentations 33 in this embodiment for interlocking with the protrusions 22 of the corresponding end of the surrounding wall 21, and a function portion 34 formed on an inner surface 311 of the contact portion 31 thereof to contact the conductor 5. The contact portions 31 of the first conductive components 3 are transverse to the axis Z and enclose the open ends of the chamber 20, respectively. The connection portions 32 of the first conductive components 3 are exposed from two opposite sides of the housing 2, and have bonding surfaces 321 which are coplanar. The connection portions 32 of the first conductive components 3 may extend and have an appropriate outline based on requirement of the bonding surfaces 321. Each of the indentations 33 of the contact portion 31 of each first conductive component 3 may be one of a hole, a notch, and a groove. In this embodiment, each of the indentations 33 is a hole. In this embodiment, the function portion 34 is a concave part, and in other embodiments, the function portion 34 may be a flat part or a convex part. It should be noted that, in other embodiments, the multi-point tilt switch may include only one first conductive component 3 that encloses one of the open ends of the chamber 20.

The second conductive components 4 and the housing 2 are integrally formed using injection molding techniques. Each of the second conductive components 4 has a contact portion 41 disposed in the chamber 20, and a connection portion 42 exposed from the housing 2. The contact portions 41 of the second conductive components 4 are disposed to surround the axis Z. The connection portions 42 of the second conductive components 4 have bonding surfaces 421 which are coplanar with the bonding surfaces 321 of the connection portions 32 of the first conductive components 3, and are exposed from the same two opposite sides of the housing 2 as those from where the connection portions 32 of the first conductive components 3 are exposed. The connection portion 32 of each of the first conductive components 3 is disposed between the connection portions 42 of adjacent two of the second conductive components 4.

The conductor 5 is accommodated in the chamber 20, and is movable in the chamber 20 between a conducting position at which the conductor 5 contacts the contact portions 31, 41 of at least two of the first and second conductive components 3, 4, and a non-conducting position at which the conductor 5 does not contact the contact portions 31, 41 of any two of the first and second conductive components 3, 4.

Referring to FIG. 4, in the normal condition, the conductor 5 sinks into the function portion 34 of one of the first conductive components 3 to be in the non-conducting position, and an open circuit is formed between each pair of the first and second conductive components 3, 4.

Figure 5:
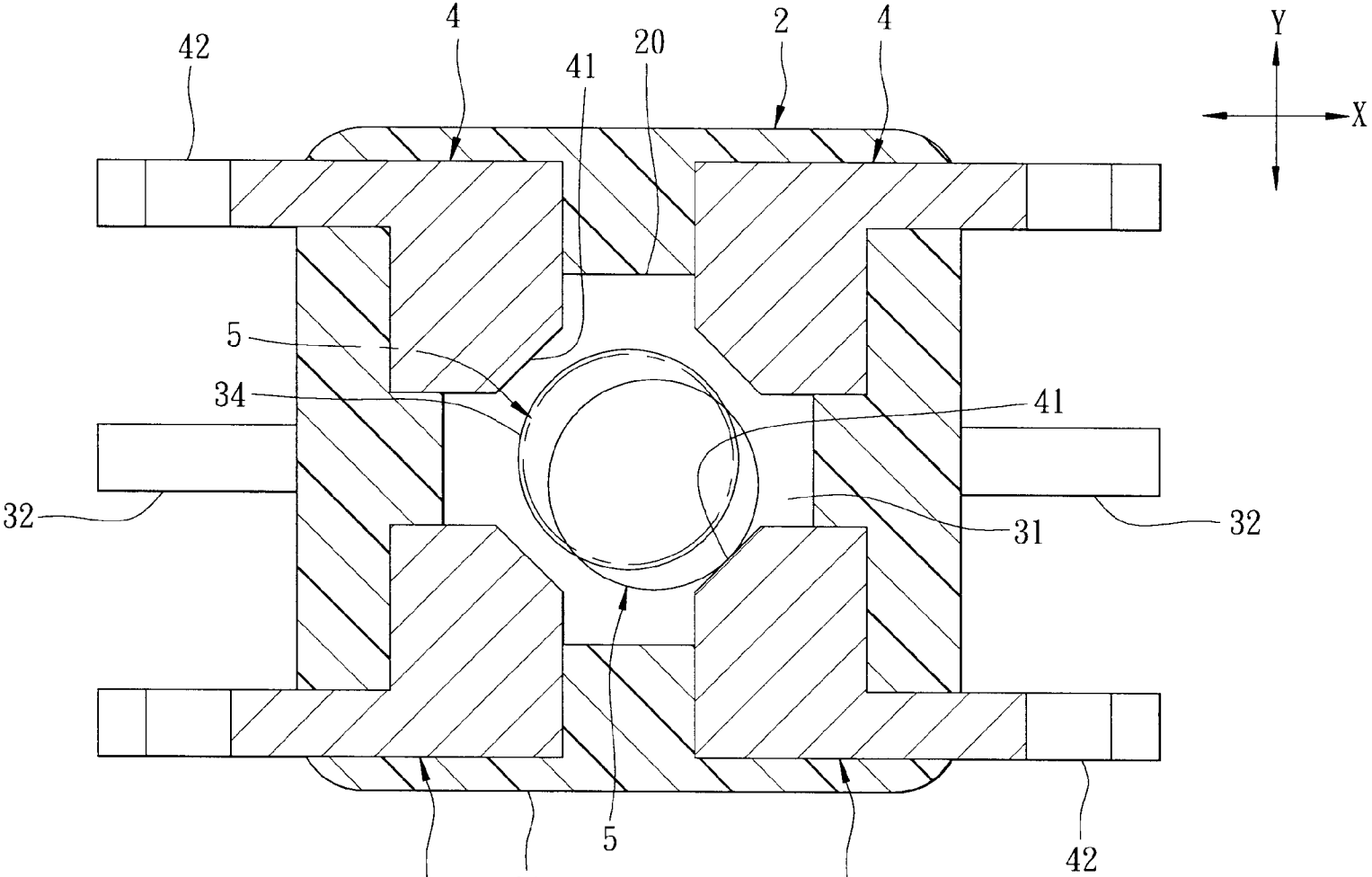
FIG. 5 is a sectional view of the first preferred embodiment taken along line V-V in FIG. 4.

Referring to FIG. 4 and FIG. 5, when the housing 2 is tilted by an external force in X or Y direction, the conductor 5 rolls in the chamber 20 according to the direction of the external force. Since the conductor 5 is located on the contact portion 31 of one of the first conductive components 3, when the conductor 5 rolls to contact the contact portion 41 of any one of the second conductive components 4, electrical connection is established between the contact portions 31, 41 of the one of the first conductive components 3 and the one of the second conductive components 4 through the conductor 5, so as to result in a first "ON" state. Since the multi-point tilt switch of this embodiment has four second conductive components 4, the first "ON" state has four implementations.

Figure 6:
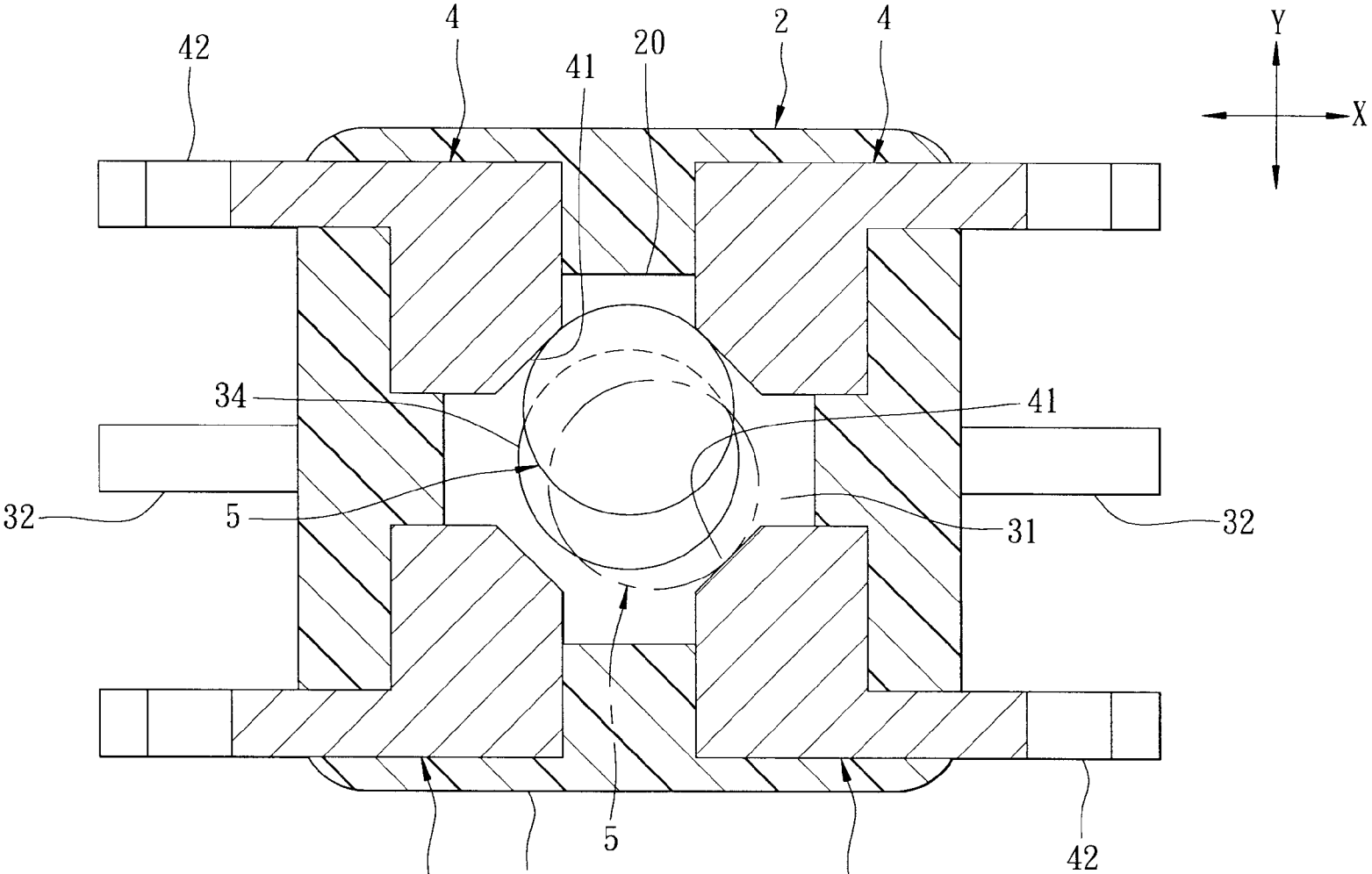
FIG. 6 is a sectional view illustrating that a conductor of the first preferred embodiment contacts three of contact portions of the first preferred embodiment.

Referring to FIG. 4 and FIG. 6, when the conductor 5 rolls to contact the contact portions 41 of adjacent two of the second conductive components 4, electrical connection is established among the contact portions 31, 41 of the one of the first conductive components 3 and the adjacent two of the second conductive components 4 through the conductor 5, so as to result in a second "ON" state. Since the multi-point tilt switch of this embodiment has four second conductive components 4 surrounding the axis Z, the second "ON" state has four implementations.

Figure 7:
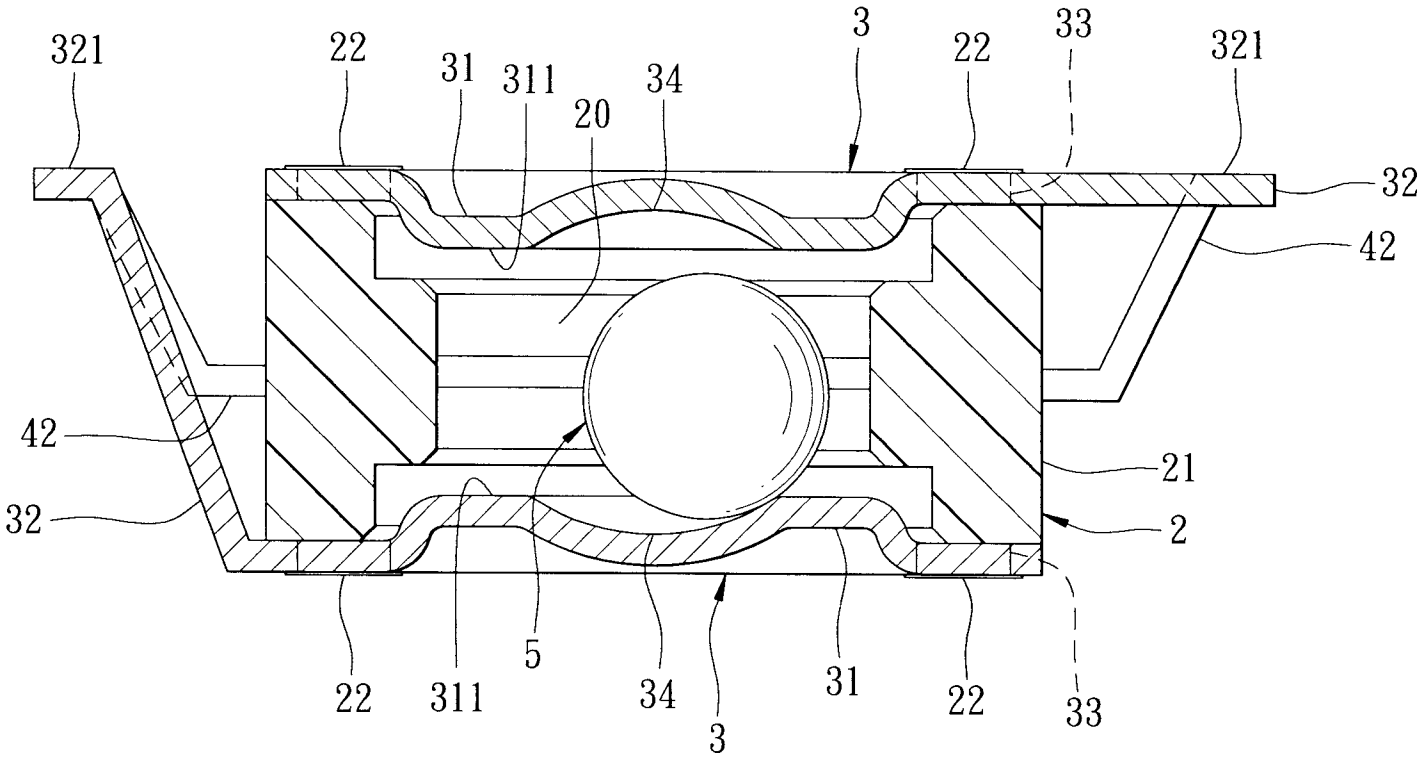
FIG. 7 is a sectional view illustrating the first preferred embodiment in an overturned state compared to FIG. 4.

Referring to FIG. 7, when the multi-point tilt switch of this embodiment is overturned such that the conductor 5 is located on the contact portion 31 of the other one of the first conductive components 3, electrical connection may be established between the contact portion 31 of said other one of the first conductive components 3 and the contact portion 41 of one of the second conductive components 4 through the conductor 5, so as to result in a third "ON" state that has four implementations, and electrical connection may also be established among the contact portion 31 of said other one of the first conductive components 3 and the contact portions 41 of adjacent two of the second conductive components 4 through the conductor 5, so as to result in a fourth "ON" state that has four implementations.

As described above, since the preferred embodiment has two first conductive components 3 and four second conductive components 4 surrounding the axis Z, (4+4)*2=16 different kinds of electrical connections may be made using this preferred embodiment.

Figure 8:
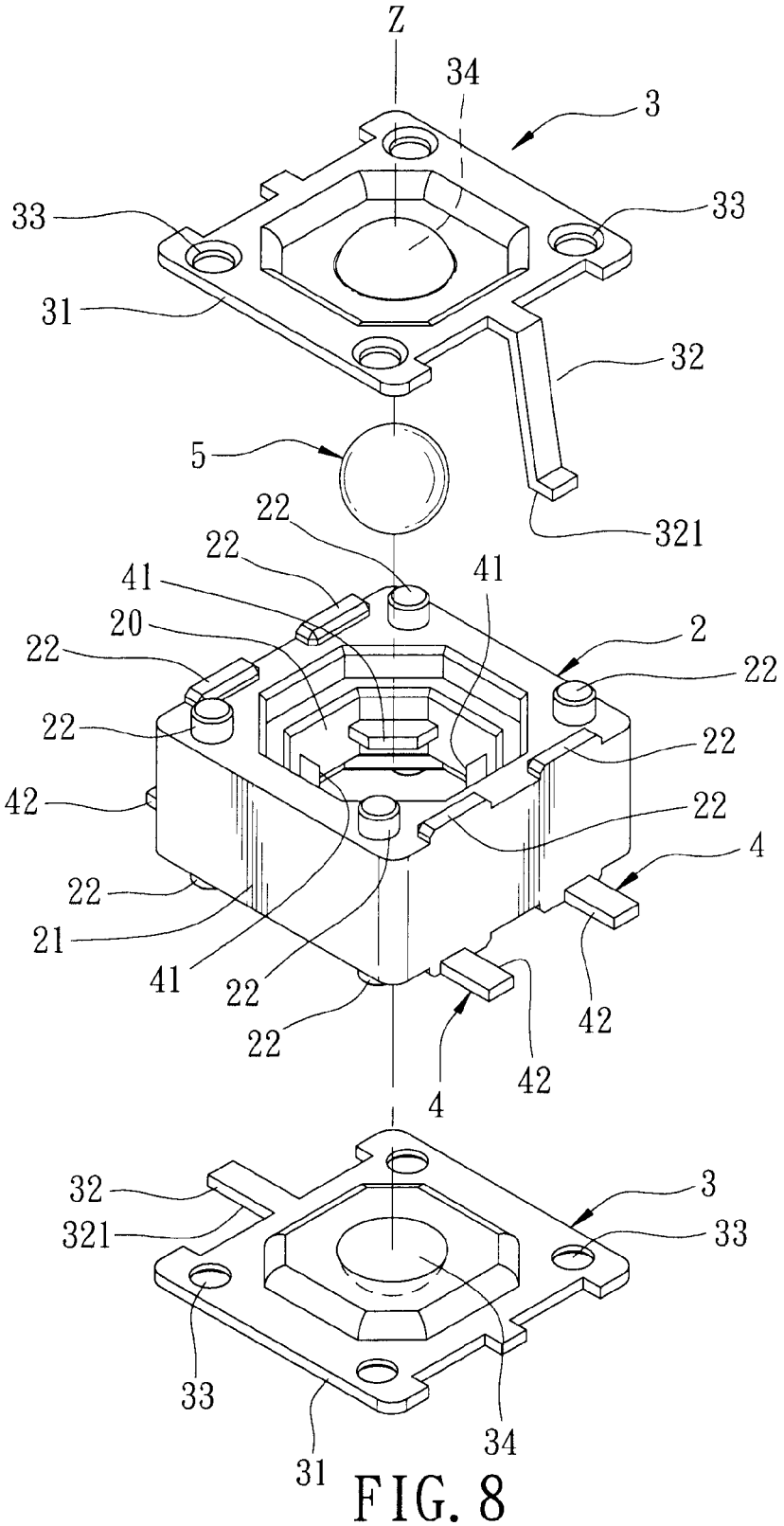
FIG. 8 is an exploded perspective view illustrating a second preferred embodiment of a multi-point tilt switch according to the present invention.
Figure 9:
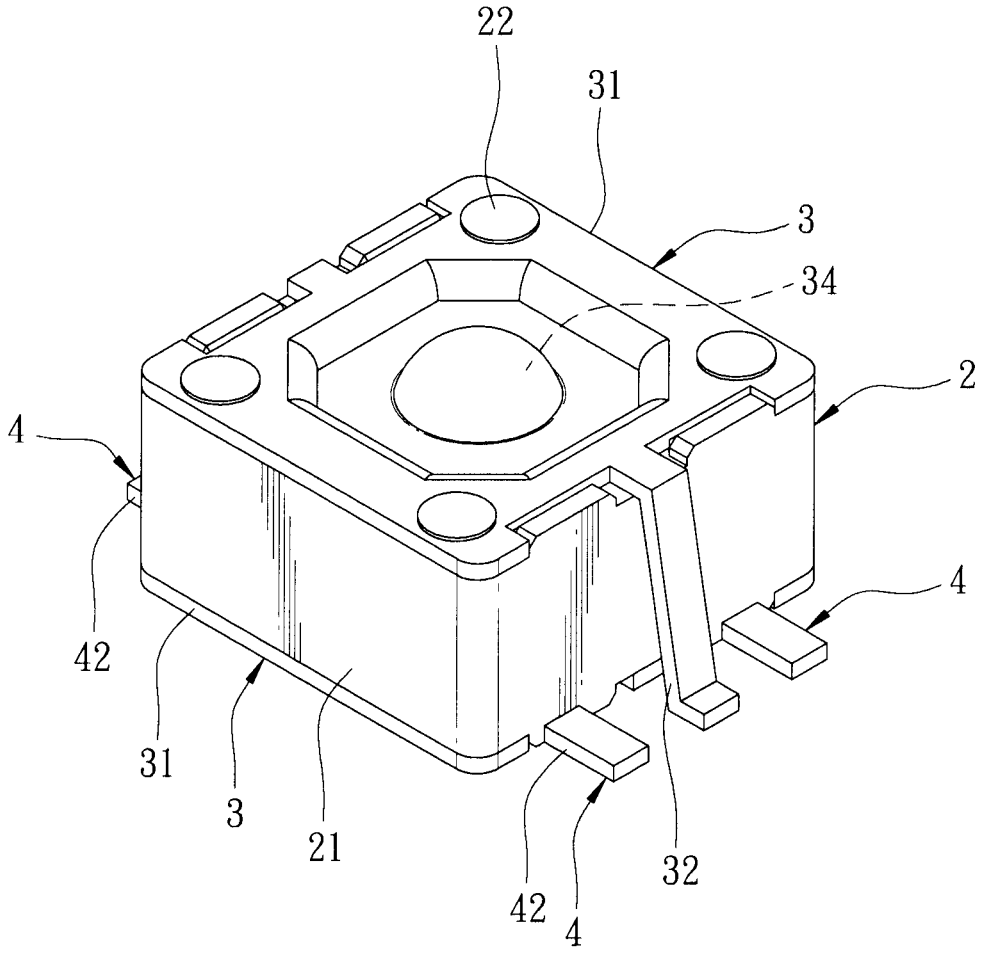
FIG. 9 is an assembled perspective view showing the second preferred embodiment.

Referring to FIG. 8 and FIG. 9, the second preferred embodiment of this invention is shown to be similar to the first preferred embodiment. The differences with the first preferred embodiment reside in that:

The protrusions 22 of the housing 2 are pillars and protruding blocks.

The indentations 33 of the first conductive components 3 are holes and notches.

Each of the connection portions 42 of the second conductive components 4 extends through the surrounding wall 21 at a position adjacent to one of the ends of the surrounding wall 21 and is exposed from outside the housing 2.

The protrusions 22 and indentations 33 may provide firm positioning during assembly of the first conductive components 3 and the housing 2 to prevent wobbling of the first conductive components 3, and thus enhance fixing.

Figure 10:
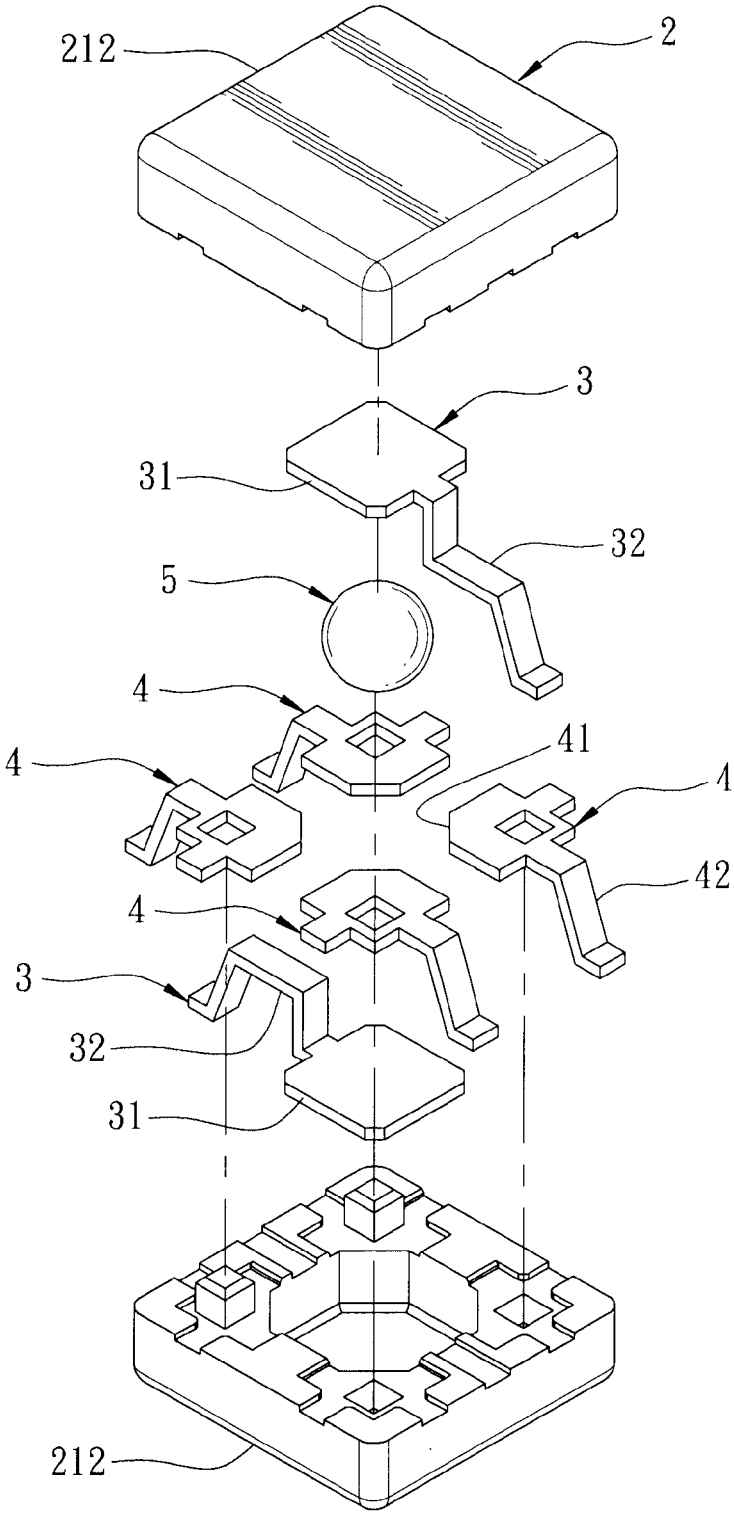
FIG. 10 is an exploded perspective view illustrating a third preferred embodiment of a multi-point tilt switch according to the present invention.
Figure 11:
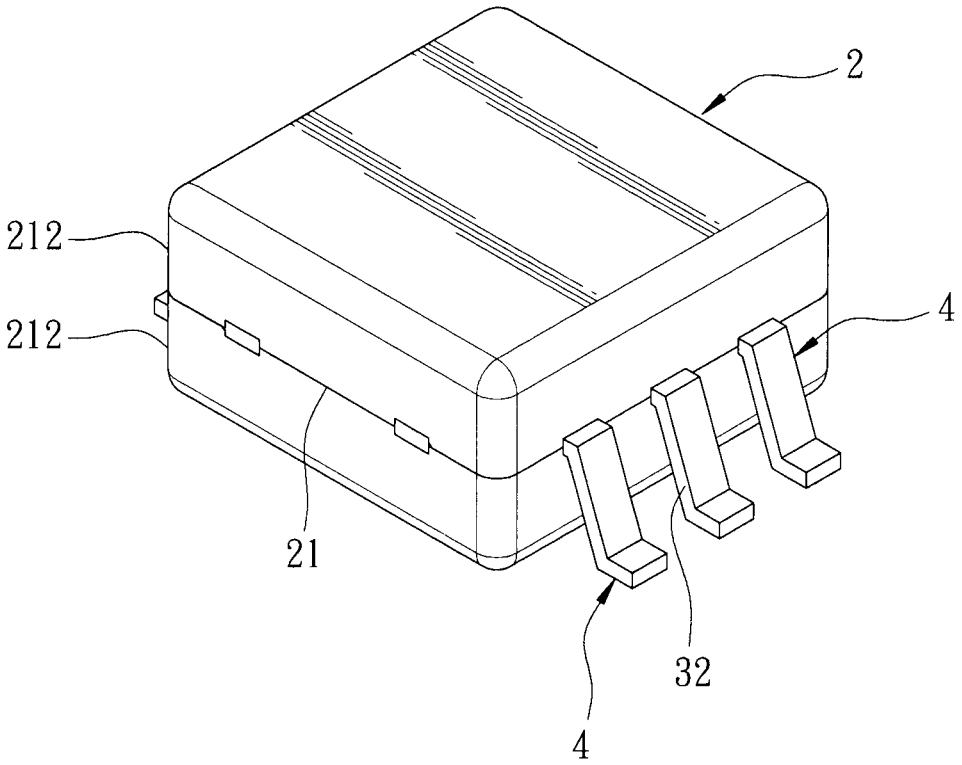
FIG. 11 is an assembled perspective view showing the third preferred embodiment.
Figure 12:
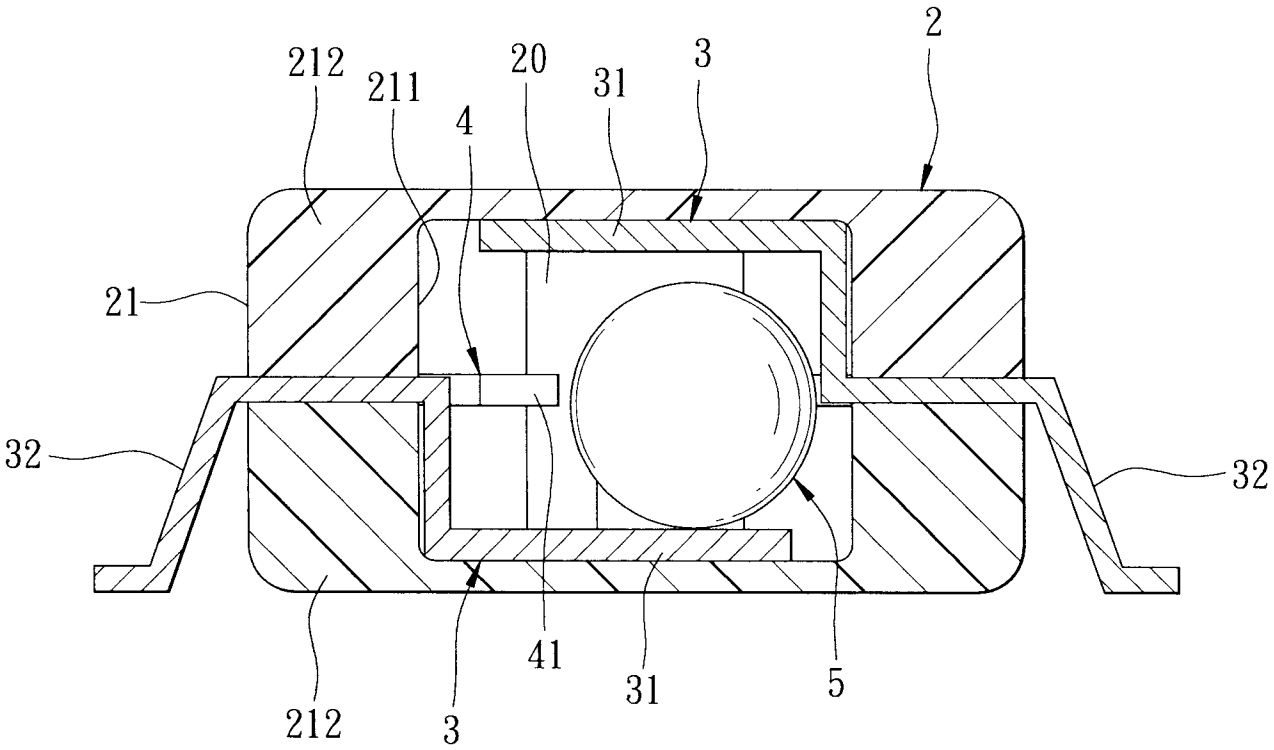
FIG. 12 is a sectional view of the third preferred embodiment.

Referring to FIGS. 10, 11, and 12, the third preferred embodiment of this invention is shown to be similar to the first preferred embodiment, and the differences reside in that:

The housing 2 is composed of two complementary housing halves 212, which are connected to each other and which respectively have annular housing half inner surfaces to form the annular housing inner surface 211. Each of the housing halves 212 further has a transverse inner surface that is transverse to a respective one of the annular housing half inner surfaces and that faces the transverse inner surface of the other one of the housing halves 212.

The annular housing half inner surfaces and the transverse inner surfaces cooperatively bound the chamber 20. Each of the contact portions 31 of the first conductive components 3 is in contact with the transverse inner surface of a corresponding one of the housing halves 212.

The second conductive components 4 are clamped between the two complementary housing halves 212 of the housing 2.

Similar to the first preferred embodiment, the third preferred embodiment also has two first conductive components 3 and four second conductive components 4 surrounding an axis, and (4+4)*2=16 different kinds of electrical connections may be implemented using the third preferred embodiment.

To sum up, the multi-point tilt switch of this invention employs the arrangement of the contact portions 32, 42 of the first and second conductive components 3, 4 to achieve ON-OFF switching in various directions in three-dimensional space, and increases number of electrical connections that may be made.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A multi-point tilt switch comprising:

an insulator housing having an annular housing inner surface surrounding a chamber;

at least one first conductive component mounted to said housing, and having a contact portion bordering said chamber, and a connection portion exposed from said housing;

a plurality of second conductive components spaced apart from said first conductive component, each of said second conductive components having a contact portion disposed in said chamber, and a connection portion exposed from said housing; and a conductor accommodated in said chamber, and movable in said chamber between a conducting position at which said conductor contacts said contact portions of at least two of said first and second conductive components, and a non-conducting position at which said conductor does not contact said contact portions of any two of said first and second conductive components;

wherein said housing has a surrounding wall that has said annular housing inner surface and that surrounds an axis, said contact portion of said first conductive component being transverse to the axis, said contact portions of said second conductive components being disposed to surround the axis.

2. The multi-point tilt switch as claimed in claim 1, comprising two of said first conductive components, said chamber having two axially opposed open ends, said contact portions of said first conductive components enclosing said open ends of said chamber, respectively.

3. The multi-point tilt switch as claimed in claim 2, wherein said surrounding wall has two axially opposite ends defining said open ends of said chamber, said opposite ends of said surrounding wall and said contact portions of said first conductive components being formed with interlocking elements, through which said first conductive components interlock with said surrounding wall, said interlocking elements including protrusions, and indentations interlocking with said protrusions.

4. The multi-point tilt switch as claimed in claim 3, wherein each of said indentations is one of a hole, a notch, and a groove, and each of said protrusions is one of a pillar, a rib, and a protruding block.

5. The multi-point tilt switch as claimed in claim 2, wherein each of said first conductive components further has a function portion formed on an inner surface of said contact portion thereof to contact said conductor, said function portion being one of a flat part, a concave part, and a convex part.

6. The multi-point tilt switch as claimed in claim 1, wherein said housing is composed of two complementary housing halves, which are connected to each other and which respectively have annular housing half inner surfaces to form said annular housing inner surface, each of said housing halves further having a transverse inner surface that is transverse to a respective one of said annular housing half inner surfaces and that faces said transverse inner surface of the other one of said housing halves, said annular housing half inner surfaces and said transverse inner surfaces cooperatively bounding said chamber, said contact portion of said first conductive component being in contact with said transverse inner surface of one of said housing halves.

7. The multi-point tilt switch as claimed in claim 1, wherein said connection portion of said first conductive component is disposed between said connection portions of adjacent two of said second conductive components.

8. The multi-point tilt switch as claimed in claim 7, wherein said connection portions of said first and second conductive components are exposed from two opposite sides of said housing.

9. The multi-point tilt switch as claimed in claim 1, wherein said connection portions of said first and second conductive components have bonding surfaces which are coplanar.

10. The multi-point tilt switch as claimed in claim 1, wherein said second conductive components and said housing are integrally formed using injection molding techniques.

* * * * *